United States Patent [19]

Airhart

[11] 3,994,319

[45] Nov. 30, 1976

[54] REED TYPE VALVE FORMED OF HIGH MODULUS FIBER REINFORCED COMPOSITE MATERIAL

[75] Inventor: Tom P. Airhart, Hurst, Tex.

[73] Assignee: Skyline Industries, Inc., Fort Worth, Tex.

[22] Filed: Feb. 14, 1975

[21] Appl. No.: 550,128

Related U.S. Application Data

[63] Continuation of Ser. No. 363,662, May 24, 1973, abandoned, which is a continuation-in-part of Ser. No. 270,610, July 11, 1972, abandoned.

[52] U.S. Cl. ..... 137/855; 251/368

[51] Int. Cl.[2] ..... F16K 15/14

[58] Field of Search ..... 137/512.15, 525, 855; 417/563, 564, 565, 566; 161/70; 29/156.7, 157.1; 251/368; 428/302, 902, 367, 368

[56] References Cited

OTHER PUBLICATIONS

Morganite Research and Development Limited. "Modmor High Modulus Carbon Fibres", Mar. 1969, p. 7. from Engineering Materials and Design Mats. Selector.

F. W. Langley, Greater Stiffness for R.P., Dec. 1967, pp. 122–123, from Composites Applications Development, Texaco Experiment, Inc., Richmond, Va.

J. Economy, Carborundum Co., High Performance Composites, Oct. 1969, from Chemical Engineering Progress (vol. 65, No. 10), pp. 46–49.

*Primary Examiner*—William R. Cline

*Attorney, Agent, or Firm*—Dressler, Goldsmith, Clement, Gordon & Shore, Ltd.

[57] ABSTRACT

The specification discloses a reed type valve formed of a composite material having a coherent matrix reinforced with fibers of high strength and high modulus of elasticity aligned along given directions to provide reinforcement against loads to be applied to the valve during operation thereof. The high modulus fibers may be of carbon or boron and preferably have an average modulus of elasticity greater than $18 \times 10^6$ psi.

8 Claims, 14 Drawing Figures

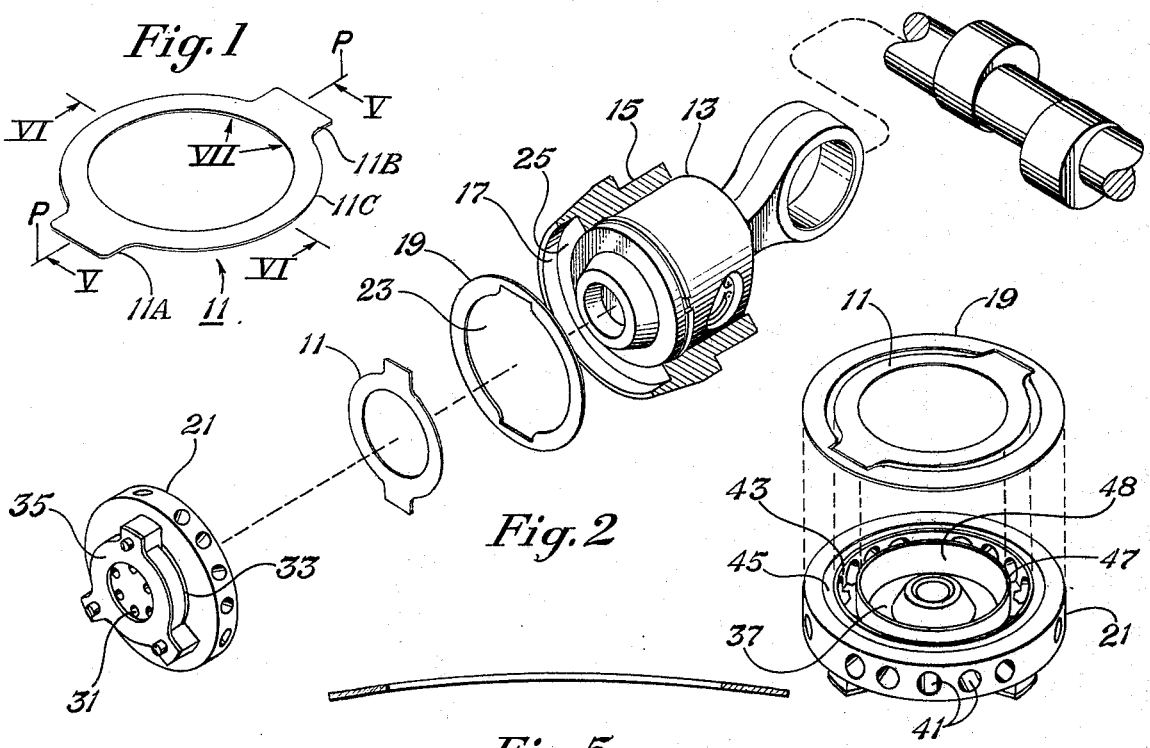
Fig. 1
P
V
VI
VII
11B
11C
11A
11
Fig. 2
15
13
25
17
19
23
11
21
35
33
31
Fig. 3
11
19
43
48
45
47
37
21
41
Fig. 5
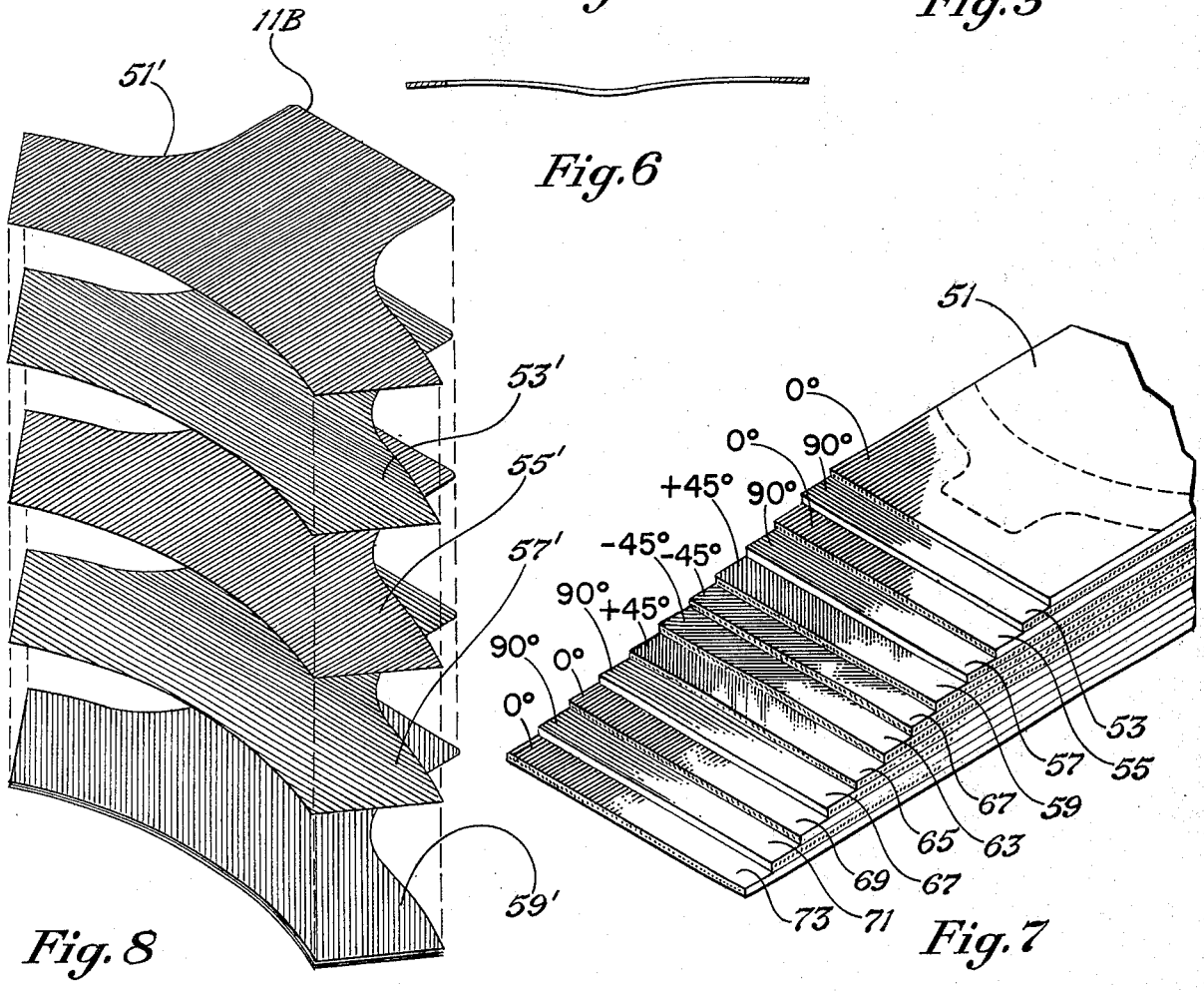
Fig. 6
11B
51'
53'
55'
57'
59'
Fig. 8
51
0°
0°
90°
+45°
90°
-45°
-45°
90°
+45°
90°
0°
0°
53
57
55
67
59
65
63
69
67
73
71
Fig. 7

REED TYPE VALVE FORMED OF HIGH MODULUS FIBER REINFORCED COMPOSITE MATERIAL

This application is a continuation application of U.S. Pat. application Ser. No. 363,662, filed May 24, 1973, now abandoned, which is a continuation-in-part of U.S. Pat. application Ser. No. 270,610, filed July 11, 1972, now abandoned.

BACKGROUND OF THE INVENTION

This invention relates to a reed type valve and more particularly to a reed type valve formed of composite materials having fibers of high modulus of elasticity.

In air conditioning and refrigeration systems employed for cooling and refrigeration purposes, compressors are provided for compressing the refrigerant vapor during the operation cycle of the system. The reciprocating compressors employ suction and discharge valves for allowing the refrigerant vapor from the evaporator to flow into the compressor cylinder where it is compressed by action of the piston and then discharged through the discharge valve to the condenser. These valves are the most critical components of the reciprocating compressor and generally are the parts of the compressor that wear out first. Many of the suction and/or discharge valves currently in use in compressors are reed type valves. Note for example pages 1–45 through 1–50 of *Basic Air Conditioning*, Vols. 1 and 2, Gerald Schweitzer and A. Ebeling, 1971; pages 124–127 of *Air Conditioning and Heating Practice*, Julian M. Laub, 1963; pages 132 and 133 of *ASHRAE, Guide and Data Book, Equipment*, 1969, published by the American Society of Heating, Refrigeration and Air Conditioning Engineers, Inc.; and pages 83–88 of *Modern Refrigeration and Air Conditioning*, A. D. Althouse and C. H. Turnquist, 1960.

These reed valves are made of spring steel and rely on the spring tension within the steel to maintain the valve closed. They are opened by the pressure differential formed across the valve during the operating cycle of the compressor. Repeated operations of these valves in the operating cycles of the compressor however causes them to wear out due to fatigue damage. When this occurs, the valves will leak and must be replaced which is a costly operation particularly if the compressor is of the closed or hermetic type.

Although the reed valves currently in use are formed of special spring steel to prolong their useful lifetime, they wear out sooner than desired. For example, in many instances, the reed valves wear out within the "5-year warranty period" generally guaranteed by the manufacturers. Thus a need exists for a reed type valve which has more resistance to fatigue than those conventionally employed in order to obtain a compressor which will operate for a longer period of time before repair is required.

SUMMARY OF THE PRESENT INVENTION

It is the object of the present invention, to provide a reed type valve which has a very high resistance to fatigue and which exhibits the desired properties of strength nd elasticity required for use in a gas compressor. The valve is formed of a composite material comprising a coherent matrix reinforced with fibers of high strength and of high modulus of elasticity aligned along given directions to provide reinforcement against loads to be applied to the valve during operation thereof. The fibers employed may be those of carbon or boron. These fibers not only have a high modulus of elasticity but also a high strength thereby providing the desired elastic properties and strength for the valve. In addition they exhibit a great resistance to fatigue and hence provide a reed type valve which is longer lasting than the conventional reed type valve made of steel spring. For use in a gas compressor, the reed type valves of the present invention may be employed for example as suction valves and/or as discharge valves.

BRIEF DESCRIPTION OF THE DRAWINGS

FIG. 1 illustrates one form of a reed type valve of the present invention;

FIGS. 2–4 illustrate the valve of FIG. 1 employed in a compressor;

FIG. 5 is a cross-section of the valve of FIG. 1, when in a flexed position, taken through lines 5—5 thereof;

FIG. 6 is a cross-section of the valve of FIG. 1 when in a flexed position, taken through the lines 6—6 thereof;

FIG. 7 is an enlarged portion of a laminate formed from a plurality of plies from which the valve of FIG. 1 is formed. An outline of a portion of the valve is shown, in a scale different from that of the laminate, to indicate the direction of the orientation of the fibers of the laminate with respect to the valve.

FIG. 8 is a partial exploded cross-sectional view of the valve of FIG. 1 taken through lines 7—7 and illustrating its construction.

DETAILED DESCRIPTION OF THE INVENTION

Figure 4:
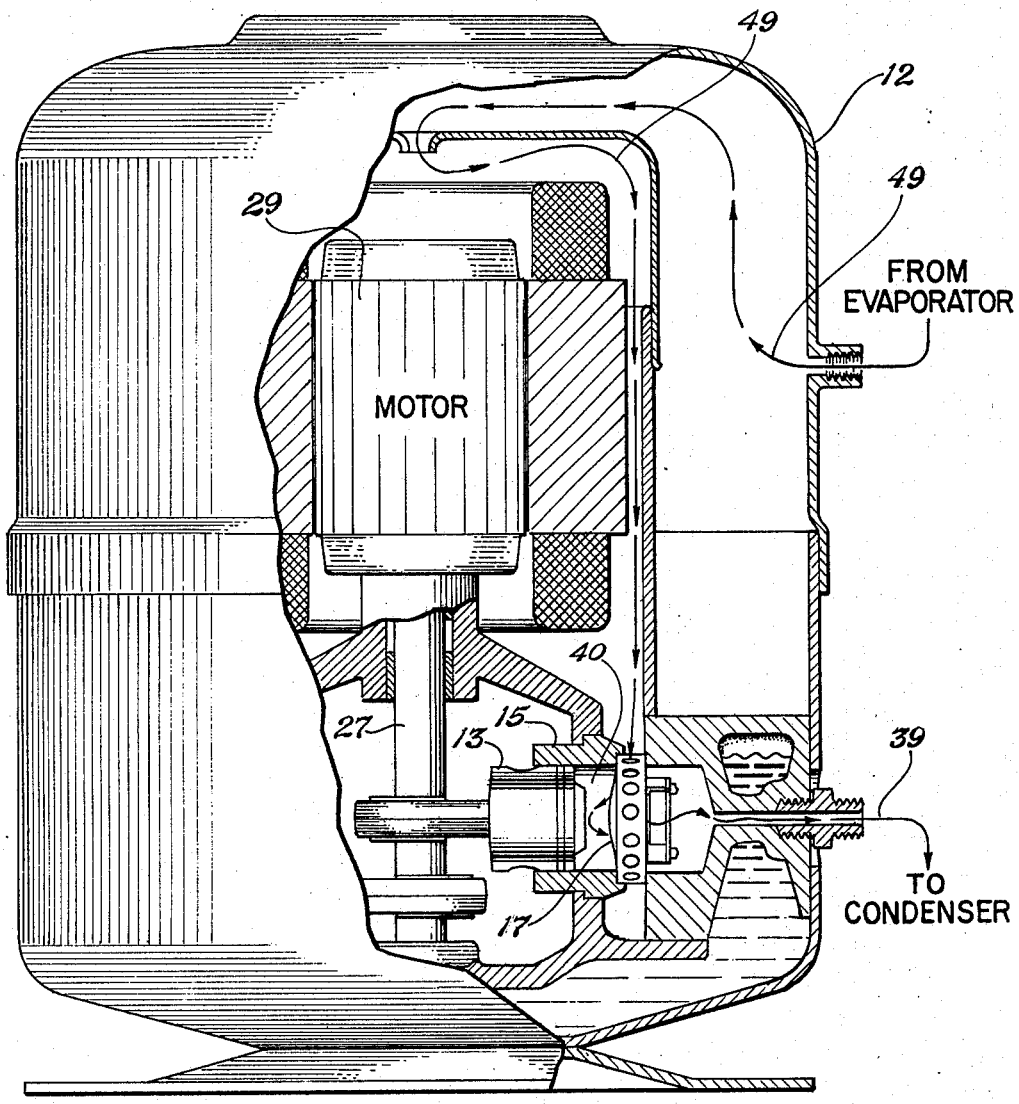

Referring now to FIGS. 1–4, there will be described one type of reed valve to which the present invention is directed. By reed valve is meant a valve that is capable of flexing and returning to a given position, due to its own elasticity. The reed valve of FIG. 1 is identified by reference character 11 and is a flat annular flexible member which is employed as a suction valve for opening and closing the suction port of a refrigerant compressor 12 of an air conditioning or refrigeration system. Heretofore, this reed valve has been made of stainless steel. Its outside diameter is about 1 13/16 inches; its inside diameter is about 1 6/16 inches; and its thickness is about 0.018 of an inch. Tabs 11A and 11B are provided for restraining purposes. One piston and cylinder of the compressor are identified at 13 and 15 respectively. The forward end of the cylinder 15 has an opening 17 formed therein for receiving the valve 11; a slightly thicker spacer ring 19; and in addition the rear portion of a disc member 21 having suction and discharge ports formed therein. The valve 11 fits into an opening 23 formed in the spacer ring 19 and the backside of the ring 19 and restraining tabs 11A and 11B of the valve 11 seat against the shoulder 25 formed in the cylinder 15. When the member 21 is inserted into the opening 17 on the forward side of the spacer ring 19 and valve 11, it holds the spacer ring in place as well as the restraining tabs 11A and 11B of the valve 11. The central portion 11C of the valve between the tabs however is allowed to flex to open and close the suction port in response to reciprocal movement of the piston 13 which is driven by cam shaft 27 and motor 29 as illustrated in FIG. 4.

The discharge port of the cylinder 15 comprises port holes 31 and openings 33 formed in the forward head 35 of member 21. It is opened and closed by a discharge valve comprising an annular ring 37 normally biased to a closed position by springs (not shown) located in the head 35 of the member 21. On the pressure or forward stroke of the piston 13, ring 37 is forced forward to allow the pressurized gas to escape from the chamber 40 of cylinder 15 by way of ports 31 and openings 33 and then to the condenser of the refrigeration system by way of a flow path depicted by arrow 39.

The suction port of the cylinder 15 comprises a plurality of port holes 41 formed in the side of member 21 and which lead to an annular cavity 43 formed in the back side of member 21 between edge 45 and an edge 47 of annular ring 48. The valve 11 seats against the edges 45 and 47 of member 21 during the pressure stroke of the piston to close the suction port. It flexes in a rearward direction, as illustrated in FIGS. 4 and 5, during the suction or backward stroke of the piston to open the suction port to allow refrigerant vapor or gas to flow from the evaporator into the chamber 40 of cylinder 15. The flow path of the gas from the evaporator to the chamber 40 is depicted at 49 in FIG. 4. The compressor illustrated in FIG. 4 is of the hermetic type and employs the gas from the evaporator to cool its motor.

FIGS. 5 and 6 illustrate one configuration to which the suction valve 11 is flexed during the suction stroke of the piston 13. As can be understood, the configurations to which the valve is bent or flexed during its operation are quite complex and the resulting strains and stresses after repeated operation tend to wear the valve out sooner than desired even though the valves heretofore have been made out of a special high quality stainless steel.

In accordance with the present invention, the reed valve of FIG. 1 as well as reed valves of other configurations and uses are formed of a composite material comprising a coherent matrix reinforced with fibers of high strength and of high modulus of elasticity. These fibers for example may be of carbon or boron and have a high modulus of elasticity as well as a high strength. They are impregnated with a matrix material or binding agent which generally is of plastic to form a family or class of materials known as "advanced composites". Heretofore these materials have been used primarily in the aerospace industry for structural purposes. For further information on these advanced composites note "Machine and Tool Blue Book", November 1971, pages 63–71; "Machinery and Production Engineering", June 17, 1970; U.S. Pat. No. 3,412,062 issued Nov. 19, 1968; and *Primer on Composite Materials: Analysis*, J. E. Ashton, J. C. Haplin, P. H. Petit, 1969.

It is noted that in the above literature the fibers of carbon are referred to both as those of carbon and graphite. In this application the term "carbon" will be used in reference to its high modulus fibers.

As indicated in the above literature, the high modulus fibers employed to form the advanced composites are produced in a manner to exhibit a high degree of preferred orientation and due to their crystalline structure have a very high modulus of elasticity and high strength. Moreover these fibers when acting in a coherent matrix have a very high resistance to fatigue. The composites formed from the high modulus fibers are available in various workable forms known as "Prepregs" wherein the fibers are impregnated with a plastic which may be a thermosetting plastic such as polyester, epoxy, polyimide, or phenolic etc. One form available is a unidirectional tape or sheet form wherein the fibers are parallel to each other and hence are aligned in a preferred direction.

By forming the reed valve 11 from a plurality of plies of the composite material in tape or sheet form, a reed valve has been produced that has a very high resistance to fatigue and in addition exhibits the strength and elastic properties required for use in a gas compressor.

The sheet form used was an epoxy resin reinforced with carbon fibers identified as HTS. The average modulus of elasticity of the fibers is between $36 \times 10^6$ psi. and $42 \times 10^6$ psi. and their average tensile strength is about $350 \times 10^3$ psi. The thickness of the sheet employed, after curing was about 0.003 of an inch. The modulus of such a composite sheet after curing is of the order of $20 \times 10^6$ psi. in the preferred fiber direction. Twelve layers or plies of the sheet were employed to form a laminate having a final thickness of about 0.036 of an inch after curing. The plies or layers were arranged to align their fibers in certain directions to provide reinforcement against the stresses and strains experienced by the valve during its flexing and seating configurations and positions.

FIG. 7 illustrates twelve layers of the sheet from which the valve was formed. These layers are identified at 51, 53, 55, 57, 59, 61, 63, 65, 67, 69, 71, and 73. The parallel lines in these layers indicate the preferred orientation of the fibers in the layers.

For example in layers 51, 55, 69, and 73, the preferred orientation of the fibers is in the 0° direction which is designated as parallel to the plane depicted by lines P—P of FIG. 1. In layers 53, 57, 67, and 71, the preferred orientation of the fibers is in the 90° direction which is perpendicular to plane P—P of FIG. 1. In layers 59 and 65, the preferred orientation of the fibers is 45° clockwise from the 0° direction while in layers 61 and 63, the preferred orientation of the fibers is 45° counterclockwise from the 0° direction.

The highest normal operating load imposed on the valve occurs as it is bent in planes parallel to plane P—P of FIG. 1 as it flexes open. Since this load is carried predominantly by the outside layers 51 and 73 they are arranged to align their fibers in the 0° direction to provide the desired reinforcement against this bending action. Layers 55 and 69 provide additional reinforcement against this bending action. Layers 53 and 71 as well as layers 57 and 67 are arranged to align their fibers in the 90° direction to provide reinforcement against the secondary bending which occurs in planes perpendicular to plane P—P of FIG. 1. Layers 59, 61, 63, and 65 provide reinforcement against bending action in the ±45° directions as the valve opens. In addition, the alignment of the fibers of the layers in the 0°, 90°, ±45° directions provide reinforcement for the valve as it seats and bridges annular edges 45 and 47 of member 21 when it closes. The arrangement of the layers symmetric about the mid-plane of the laminate insures that the valve will return to its normal flat form after it flexes to obtain the desired sealing action when it closes. The overall modulus of the final cured laminate in the 0° direction is about $10 \times 10^6$ psi.

In forming the valve from the twelve plies of composite material, the plies or layers are arranged to align their fibers in the desired 0°, 90°, ±45° directions as indicated above to form a laminate stack or layup as illustrated in FIG. 7. Pressure and heat then are applied to the stack or layup to cure and set the epoxy to form a coherent laminate matrix reinforced by the fibers aligned in the desired directions. The pressure may be applied by a vacuum bag in an autoclave transverse to the planes of the twelve layers forming the stack or layup. The pressure applied may be between 50 to 60 psi. while the heating temperature applied may be about 350° F. The pressure and heat may be applied for about one-half hour to an hour to cure and set the epoxy. After the laminate has been cured, the valve may be stamped or machined from the resulting sheet. In the stamping or machining operation the tabs 11A and 11B of the valve 11 will be aligned with the parallel lines of the top layer 51 as illustrated in FIG. 8 whereby the fibers of the various plies will be aligned in the desired directions. In FIG. 8, part of the layers forming the completed reed valve are illustrated at 51', 53', 55', 57' and 59' showing their fiber directions. In the curing process the individual layers will be bonded together to form a coherent mass or laminate with the fibers aligned in directions dependent upon the direction of alignment of their respective layers prior to curing.

If relatively thick valves are desired to be formed from a plurality of plies, it may be desirable to stamp the valve from the layup formed while it is still in a "wet" stage and before the epoxy or plastic has been cured. The resulting stamped form then will be cured under heat and pressure after which the valve may be machined to obtain the exact dimensions desired.

It is to be understood that the reed valve 11 of FIG. 1 is merely one type of reed valve which may be formed in accordance with the present invention and that other configurations may be formed as well as reed valves which may be used as discharge valves for gas compressors rather than suction valves. The valve formed may be used not only in compressors of refrigeration systems but in compressors of heat pumps, or for example in air compressors. In addition reed valves for other uses may be formed in accordance with the present invention.

It is to be understood also that other types of high modulus fibers may be employed to form the reed valves. For example referring to Table I there is listed a number of high modulus fibers, and their mechanical properties, which may be employed for forming reed valves of various configurations and shapes.

TABLE I

COMPOSITE MATERIALS FOR REED VALVES

| Type of Fiber | Company | Trade Name | Tensile Strength psi × $10^3$ | Modulus of Elasticity psi × $10^6$ |
|---|---|---|---|---|
| High Modulus Carbon (Graphite) | Hercules, Inc. | HTS | 350 | 36–42 |
| | | AS | 390 | 28–34 |
| | | HMS | 300 | 53–59 |
| | Morganite Research and Development Limited, London, England | Type II | 350 | 35 |
| | | Type I | 300 | 55 |
| | | Type III | 350 | 30 |
| | Celanese | Celion GY-70 | 250 | 75–80 |
| | Union Carbide | Thornel 50 | 285 | 55–60 |
| | | Thornel 75 | 380 | 75–80 |
| | | Thornel 300 | 300 | 30–35 |
| | Rolls Royce, England | Hyfil 2710 | 350 | 28 |
| | Great Lakes Carbon Corporation | 3T | 300 | 30 |
| | | 4T | 350 | 38 |
| | | 5T | 400 | 48 |
| | | 6T | 420 | 58 |
| Boron | Hamilton Standard; AVCO Systems Division | | 400 | 50 |

All of the high modulus fibers of Table I are available commercially from the companies listed. In this table, the tensile strength and modulus of elasticity listed for the fibers are the average tensile strength and the average modulus of elasticity. The matrix of the carbon and boron fibers may be of the thermosetting type such as polyester, epoxy, polyimide, phenolic, etc. They may be obtained in prepreg form from some of these companies and from other companies. All of the carbon fibers of Table I except the Union Carbide Thornel 50 and 75, are formed from polyacrylonitrile (PAN) as the precursor. Rayon is used as the precursor in forming the Union Carbide Thornel 50 and 75 carbon fibers. In addition, metal rather than plastic may be employed as the matrix for some of the fibers of Table I. For example the matrix for the boron fibers as well as for some of the carbon fibers may be of aluminum.

Other types of high modulus fibers also are available commercially from which the valves may be formed. For example a high modulus organic fiber is available from DuPont Corporation and known as PRD-49. It has an average tensile strength of $300 \times 10^3$ psi. and an average modulus of elasticity of about $20 \times 10^6$ psi.

In all of the above high modulus fibers mentioned and listed it is noted that they have a high tensile strength and in addition an average high modulus of elasticity which is above $18 \times 10^6$ psi. The high tensile strength is desired to provide the desired strength for the valve while the high modulus of elasticity is desired to provide the required stiffness and elasticity. In the formation of the reed type valves, the average modulus of elasticity of the reinforcing fibers should not be below about $18 \times 10^6$ psi. since otherwise the reed valve may flex open too much when it opens in a compressor thereby shortening its lifetime.

In forming the particular valve 11 of FIG. 1, it was found that the preferred range for the average modulus of elasticity should be between $30 \times 10^6$ psi. and $50 \times 10^6$ psi. while the average tensile strength should be above $300 \times 10^3$ psi. in order to obtain the desired elasticity and strength for it to operate satisfactorily as a suction valve for the particular cylinder and compressor illustrated. The Hercules, Inc. HTS carbon fibers for example could be employed as well as the Morganite Type II carbon fibers since their modulus of elasticity and tensile strength fall within the ranges stated. For other valves of different configurations and shapes, these fibers, as well as the other fibers mentioned and listed may be employed since they all have a high modulus of elasticity, a high tensile strength and exhibit a high resistance to fatigue damage.

As stated above, the most critical part of the compressor is its suction and discharge valves and these valves heretofore have limited the size of the piston and cylinders and hence the capacity of the compressors. For example if the reed valve 11 were formed of steel, and were made much larger than the dimensions given, it would wear out even sooner. By forming the reed valve from the high modulus composite materials, however, the valve will have a greater resistance to fatigue damage and hence can be made larger without serious affect on its lifetime and hence will increase the cooling capacity of the compressor for the dollar invested. The lifetime of the valves may be increased even further by applying a protective coating, such as polyurethane, to the valves to prevent erosion of the valves due to gas flowing over the surface of the valves.

Although the present valve 11 was described as being formed from a laminate produced from a plurality of plies of high modulus material, it is to be understood that it could be formed from high modulus fibers by other techniques. For example, the reinforcing high modulus fibers may be cut into short lengths and incorporated into a liquid plastic matrix to produce a viscous mass which may be forced into a die cavity having the desired shape of the valve. The flow direction would be from one tab to the other to allow a large proportion of the fibers to align along their flow direction to form the desired reinforcement against the primary load imposed on the valve due to the bending action in planes parallel to plane P—P of FIG. 1. Pressure could then be applied to the plastic material in the cavity to force many of the fibers to be aligned in other directions within the two dimensional plane of the valve to obtain the additional reinforcement desired. The materials could then be cured under pressure and heat and machined after curing to form the desired valve.

If a reed type valve is to be employed in machines or devices where a high temperature is not present, then the valves may be formed from a composite material which employs a thermoplastic polymer as its matrix rather than a thermosetting polymer.

Figure 9:
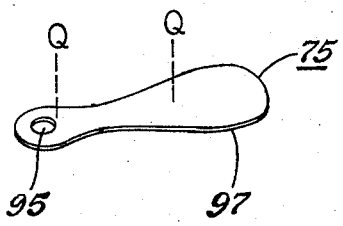
FIGS. 9 and 10 are different types of reed type valves which may be formed in accordance with the present invention.
Figure 10:
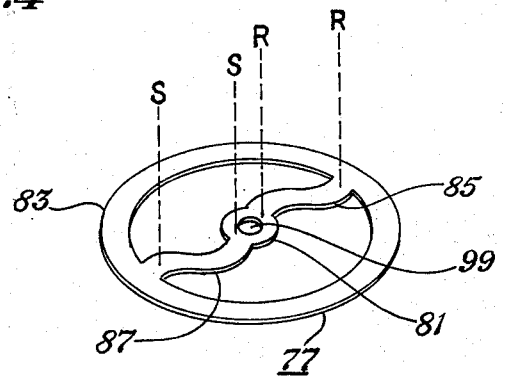

Referring now to FIGS. 9 and 10, there are illustrated valves of different configuration which may be formed from the composite materials having the fibers of high modulus of elasticity. FIG. 9 illustrates a conventional flat reed or flapper type valve 75 while FIG. 10 illustrates another type of flat reed valve 77 having a central hub 81 connected with an annular ring 83 by way of spokes 85 and 87. The valve 75 is secured with a pin inserted through aperture 95 to allow the body portion 97 to flex in directions generally transverse to its normal flat plane to open and close a port. The valve 77 is held in place by a pin inserted through aperture 99. Its flat annular ring 83 is adapted to move in directions generally transverse to the normal plane of the valve, to open and close a port, through the flexing action of its spokes 85 and 87.

The predominant bending action of valve 75 will be in planes parallel to the plane defined by dotted lines Q—Q while the predominant bending action of valve 77 will be in planes parallel to the planes defined by dotted lines R—R and S—S. In order to provide the desired reinforcement against these bending actions, valve 75 will have a large proportion of fibers aligned along its length while valve 77 will have a large proportion of fibers aligned along the lengths of its two spokes 85 and 87 to reinforce against the primary loads. In addition the fibers of the valves will be aligned along other directions to provide the additional reinforcement required.

Figure 11:
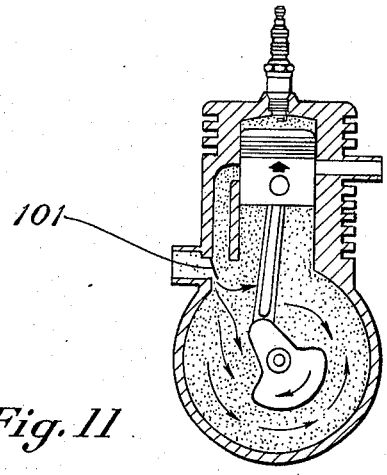
FIGS. 11 and 12 illustrate a two-cycle internal combustion engine with its reed valve in open and closed positions respectively.
Figure 12:
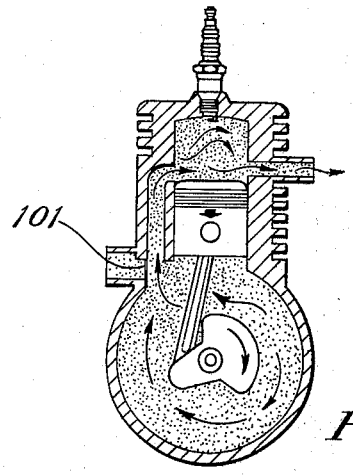
Figure 13:
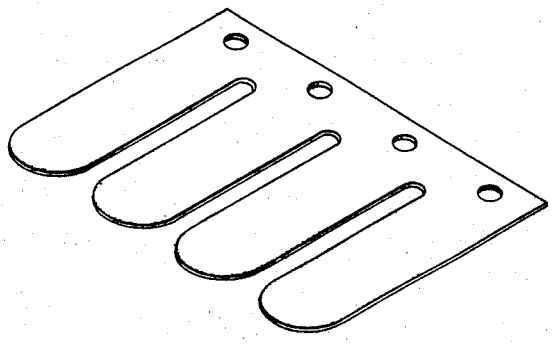
FIG. 13 illustrates a reed type valve having four fingers for use in a two-cycle internal combustion engine.

As indicated above, reed type valves made in accordance with the present invention may be used not only in compressors but in other types of machinery such as two-cycle internal combustion engines used for motorcycles, power driven chain saws, outboard motors for small boats, etc. Generally, two-cycle engines employ reed type valves in their inlet ports as illustrated in FIGS. 11 and 12 wherein reference numeral 101 identifies a reed valve employed for opening and closing the inlet port of the two-cycle engine. Reference may be made to *Evinrude Outboard Motor Repair and Tune-Up Guide* by Harold T. Glen, 1969, Cowles Book Company, Inc., New York, Pages 100–102 for a description of the operation of such engines. Note also pages 3–5, *Motorcycle Service Manual* Second Edition, Vol. 1, 1968, Technical Publications Div., Intertec Publishing Corporation, 1014 Wyandotte Street, Kansas City, Missouri, 64105. FIGS. 11 and 12 are merely schematic illustrations of a two-cycle engine illustrating its reed type valve in open and closed positions. The reed type valves employed may have different configurations. For example, such valves may have two or four fingers, a four-fingered reed type valve being illustrated in FIG. 13. A four-fingered reed type valve made of stainless steel currently is employed, for example, in two-cycle engines manufactured by Outboard Marine for Evinrude. As indicated above, reed type valves made from stainless steel have disadvantages in that they do not have the lifetime desired. Moreover, in the event that a stainless steel reed valve breaks in a two-cycle engine, severe damage is likely to occur to the engine.

Figure 14:
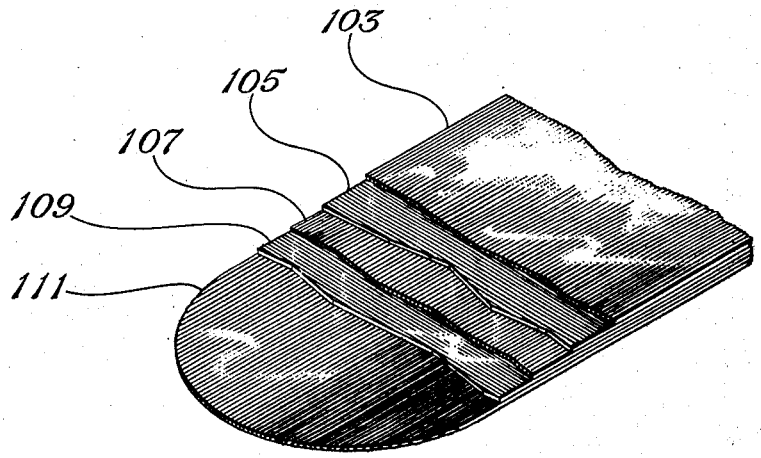
FIG. 14 is an enlarged portion of a portion of a laminate formed from a plurality of plies in accordance with the present invention to form the reed type valve illustrated in FIG. 13.

In accordance with the present invention, reed type valves for use for internal combustion engines are formed of a composite material comprising a coherent matrix reinforced with fibers of high strength and of high modulus of elasticity aligned along given directions to provide reinforcement against loads to be applied to the valve during operation thereof. The fibers employed may be those of carbon or boron as set forth in Table I. As one example, in accordance with the present invention, the reed type valve of FIG. 13 was formed from five plies of high modulus composite material in sheet form. The sheet form used was an epoxy resin reinforced with carbon fibers identified as HTS (see Table I). As indicated above, the average modulus of elasticity of the fibers is between $36 \times 10^6$ psi and $42 \times 10^6$ psi and their average tensile strength is about $350 \times 10^3$ psi. Five layers or plies of the sheet were employed to form a laminate having a final thickness of about 0.010–0.015 of an inch after curing. The plies or layers were arranged to align their fibers in preferred directions to provide reinforcement against the stresses and strains experienced by the valve during its flexing and seating configurations and positions. FIG. 14 illustrates the five layers of the sheet from which the valve was formed. These layers are identified at 103, 105, 107, 109, and 111. The parallel lines in these layers indicate the preferred orientation of the fibers in the layers. For example, in layers 103, 107, and 111, the preferred orientation of the fibers is in the zero direction which is designated as parallel to the length of the finger while in layers 105 and 109, the preferred orientation of the fibers is in the 90° direction which is perpendicular to the fibers of layers of 103, 107, and 111. It is to be understood that the reed type valve of FIG. 14 may employ more or less than five layers, for example, in certain cases, the reed type valve may be formed only from layers 103, 105, and 107.

Although the valve of FIG. 14 was described as being formed from a laminate produced from a plurality of plies of high modulus material, it is to be understood that it could be formed from high modulus fibers by other techniques. For example, reinforcing high modulus fibers may be cut into short lengths and incorporated into a liquid plastic mixed to produce a viscous mass which may be forced into a die cavity having the desired shape of the valve and proper pressure applied to the material in the cavity to force many of the fibers to be aligned in the preferred directions. The materials could then be cured under pressure and heat and machined after curing to form the desired valve.

From experience, it has been found reed type valves made in accordance with the present invention employed for compressors or for internal combustion engines are superior to those which have been previously produced from stainless steel or other materials.

I claim:

1. A reed type valve constituted by a thin flexible flat laminated sheet of a plurality of plies of a coherent matrix binding material, each of said plies containing straight parallel carbon fibers having an average tensile strength above $300 \times 10^3$ psi and an average modulus of elasticity greater than $18 \times 10^6$ psi, said sheet having at least one tab portion which is held to support the valve in use, and a flexing portion extending from said tab portion, said sheet including outer plies in which the said fibers are oriented to run from said flexing portion to said tab portion, and inner plies in which the said fibers are oriented to run in other directions, whereby said reed valve will possess a superior combination of flexibility and resistance to stress and strain.

2. A reed type valve as recited in claim 1 in which said fibers have an average modulus of elasticity within the range of $30 \times 10^6$ psi – $50 \times 10^6$ psi.

3. A reed type valve as recited in claim 1 in which said coherent matrix binding material is a thermosetting resin.

4. A reed type valve as recited in claim 3 in which said thermosetting resin is an epoxy resin.

5. In a gas compressor having a reed type valve for repetitively opening and closing a port, said valve being opened by a pressure differential across the valve and which closes by its own elasticity upon equalization of the pressure differential, an improved reed type valve constituted by a thin flexible flat laminated sheet of a plurality of plies of a coherent matrix binding material, each of said plies containing straight parallel carbon fibers having an average tensile strength above $300 \times 10^3$ psi and an average modulus of elasticity greater than $18 \times 10^6$ psi, said sheet having at least one tab portion which is held to support the valve in use, and a flexing portion extending from said tab portion, said sheet including outer plies in which the said fibers are oriented to run from said flexing portion to said tab portion, and inner plies in which the said fibers are oriented to run in other directions, whereby said reed valve will possess a superior combination of flexibility and resistance to stress and strain.

6. The combination of claim 5 in which said fibers have an average modulus of elasticity within the range of $30 \times 10^6$ psi – $50 \times 10^6$ psi, and said coherent matrix binding material is a thermosetting resin.

7. In an internal combustion engine having a reed type valve for repetitively opening and closing a port, said valve being opened by a pressure differential across the valve and which closes by its own elasticity upon equalization of the pressure differential, an improved reed type valve constituted by a thin flexible flat laminated sheet of a plurality of plies of a coherent matrix binding material, each of said plies containing straight parallel carbon fibers having an average tensile strength above $300 \times 10^3$ psi and an average modulus of elasticity greater than $18 \times 10^6$ psi, said sheet having at least one tab portion which is held to support the valve in use, and a flexing portion extending from said tab portion, said sheet including outer plies in which the said fibers are oriented to run from said flexing portion to said tab portion, and inner plies in which the said fibers are oriented to run in other directions, whereby said reed valve will possess a superior combination of flexibility and resistance to stress and strain.

8. The combination of claim 7 in which said fibers have an average modulus of elasticity within the range of $30 \times 10^6$ psi – $50 \times 10^6$ psi and said coherent matrix binding material is a thermosetting resin.

* * * * *

Disclaimer 3,994,319.—*Tom P. Airhart*, Hurst, Tex. REED TYPE VALVE FORMED OF HIGH MODULUS FIBER REINFORCED COMPOSITE MATERIAL. Patent dated Nov. 30, 1976. Disclaimer filed Aug. 20, 1976, by the inventor.

The term of this patent subsequent to Oct. 5, 1993 has been disclaimed.

[*Official Gazette January 18, 1977.*]